US006032805A

United States Patent [19]

Clark et al.

[11] Patent Number: 6,032,805

[45] Date of Patent: Mar. 7, 2000

[54] ENHANCED EFFECTIVENESS OF SULFOXY COMPOUNDS IN FLOTATION CIRCUITS

[75] Inventors: David William Clark, Gladesville; Andrew James Haigh Newell, Chatswood, both of Australia

[73] Assignee: BOC Gases Australia Limited, New South Wales, Australia

[21] Appl. No.: 09/114,679

[22] Filed: Jul. 13, 1998

[30] Foreign Application Priority Data

Jul. 14, 1997 [AU] Australia ..... P07884

[51] Int. Cl.[7] ..... B03D 1/02; B03B 1/04; B03B 1/00

[52] U.S. Cl. ..... 209/164; 209/1; 209/166; 209/167

[58] Field of Search ..... 209/164, 166, 209/167, 1

[56] References Cited

U.S. PATENT DOCUMENTS

| | | |
|---|---|---|
| 1,279,040 | 9/1918 | Thomas . |
| 1,505,323 | 8/1924 | Eberenz . |
| 2,048,370 | 7/1936 | Brinker . |
| 2,154,092 | 4/1939 | Hunt . |
| 4,735,783 | 4/1988 | Bulatovic . |
| 5,411,148 | 5/1995 | Kelebek . |
| 5,653,945 | 8/1997 | Gathje . |

FOREIGN PATENT DOCUMENTS

| | | |
|---|---|---|
| 499430 | 12/1976 | Australia . |
| 39027/95 | 5/1996 | Australia . |
| 2163688 | 5/1996 | Canada . |
| 37-15310 | 9/1962 | Japan . |
| 60-220155 | 10/1985 | Japan . |
| 96/01150 | 1/1996 | WIPO . |
| WO 96/01150 | 1/1996 | WIPO . |

OTHER PUBLICATIONS

Kongolo et al "Improving the efficiency of sulfidization of oxidized copper ores by column and inert gas flotation", Proceedings of Copper 95—Cobra 95 International Conference, vol. II, The Metallurgical Society of CIM, pp. 183–196, 1995.

Ohstott et al, "By–Product Molyldenum Flotation From Copper Sulfide Concentrate with Nitrogen Gas In Enlosed Wemco Nitrogen Flotation Machines", Preprint No. 84–65 (1984), Society of Mining Engineers of AIME, Feb. 26–Mar. 1, 1984.

Burger, "Froth Flotation Developments: The Industry Workhorse Goes from Strength to Strength," E&MJ, pp. 67–75, Sep. 1983.

Xu et al "Sphalerite Reverse Flotation Using Nitrogen," Proc. Eletrochemical Society, vol. 92–17, Pro. Int. Symp. Electrochem. Miner. Met. Process, III, 3rd pp. 170–190, 1992.

*Primary Examiner*—Thomas M. Lithgow

[57] ABSTRACT

A method of increasing both flotation selectivity and effectiveness of a sulfoxy radical-containing reagent added to a mineral separation circuit. The method involves adding a non-oxidizing gas to the mineral separation circuit prior to and/or simultaneously with the addition of the sulfoxy radical-containing reagent in a quantity sufficient to achieve a chemical environment conducive to flotation separation of minerals. The process is suitable for use with a broad range of slurries and flotation concentrates having a mixture of valuable materials including sulfidic copper minerals, sulfidic and non-sulfidic copper minerals, valuable lead and/or zinc and/or nickel minerals, sulfidic iron minerals (particularly pyrite) and non-sulfidic gangue material. It is particularly suitable for polymetallic ores containing economic values of copper and/or lead and/or zinc and/or nickel which is frequently in association with iron sulfide.

8 Claims, 3 Drawing Sheets

ENHANCED EFFECTIVENESS OF SULFOXY COMPOUNDS IN FLOTATION CIRCUITS

The present invention relates to mineral separation circuits and particularly, but not only, mineral separation circuits employing sulfoxy compounds as reagents.

BACKGROUND OF THE INVENTION

In the flotation separation of minerals, reagents containing a sulfoxy radical, such as sodium sulfite, sodium bisulfite and sodium metabisulfite (or alkali metal, alkaline earth metal or ammonium equivalents thereof), sulfur dioxide or other thionates are commonly used to improve the quality of the separation, particularly where sulfidic minerals such as chalcopyrite, pentlandite, pyrite, sphalerite, pyrrhotite or galena are present.

The sulfoxy radical-containing reagents act to depress certain minerals to allow an operator to selectively float the desired valuable sulfidic mineral.

There are, however, certain difficulties associated with the use of sulfoxy radical-containing reagents in flotation separation circuits. First, the cost of such reagents is quite high and it would prove beneficial if consumption thereof could be reduced or alternatively the quality or grade of the valuable concentrate could be increased using the same quantity of reagent.

Also, the effectiveness of the sulfoxy radical-containing reagent depends on a number of factors including pH, dissolved oxygen content of the slurry and the type of ore forming the slurry. For example, at relatively low concentrations of sodium sulfite, pyrite flotation is markedly slowed. This effect is increased at a higher pH level (by the addition of sodium hydroxide or lime). Depression of sphalerite by sodium sulfite has been previously reported, however, its effectiveness is not always clear. Sulfite addition does not appear to increase or decrease chalcopyrite flotation rates.

The effectiveness of the sulfoxy radical-containing reagent also depends upon conditioning times. Experience has shown that conditioning times have a marked effect on the flotation selectivity of certain ores. Also, the effectiveness of the sulfoxy radical-containing reagent depends upon the particle size of the minerals in the slurry. It has been found that finer sizes of sulfide minerals can be less sensitive to sulfoxy radical-containing reagent conditioning i.e. longer conditioning times may be required to depress certain minerals.

Of course, in addition to these difficulties, it is necessary for a plant operator to supply the selected sulfoxy radical-containing reagent to the plant site which is usually at a remote location. Transport, storage and preparation of the these reagents for use results in substantial additional costs.

Accordingly, it is an object of the present invention to overcome at least some of the disadvantages of the prior art or provide a commercial alternative thereto.

SUMMARY OF THE INVENTION

The present invention provides a method of increasing both flotation selectivity and effectiveness of sulfoxy radical-containing reagents added to a mineral separation circuit wherein prior to or simultaneously with the addition of the sulfoxy radical-containing reagent a non-oxidizing gas is introduced to the mineral separation circuit in a quantity sufficient to achieve a chemical environment conducive to flotation separation of minerals.

DETAILED DESCRIPTION OF THE PREFERRED EMBODIMENTS

Figure 1:
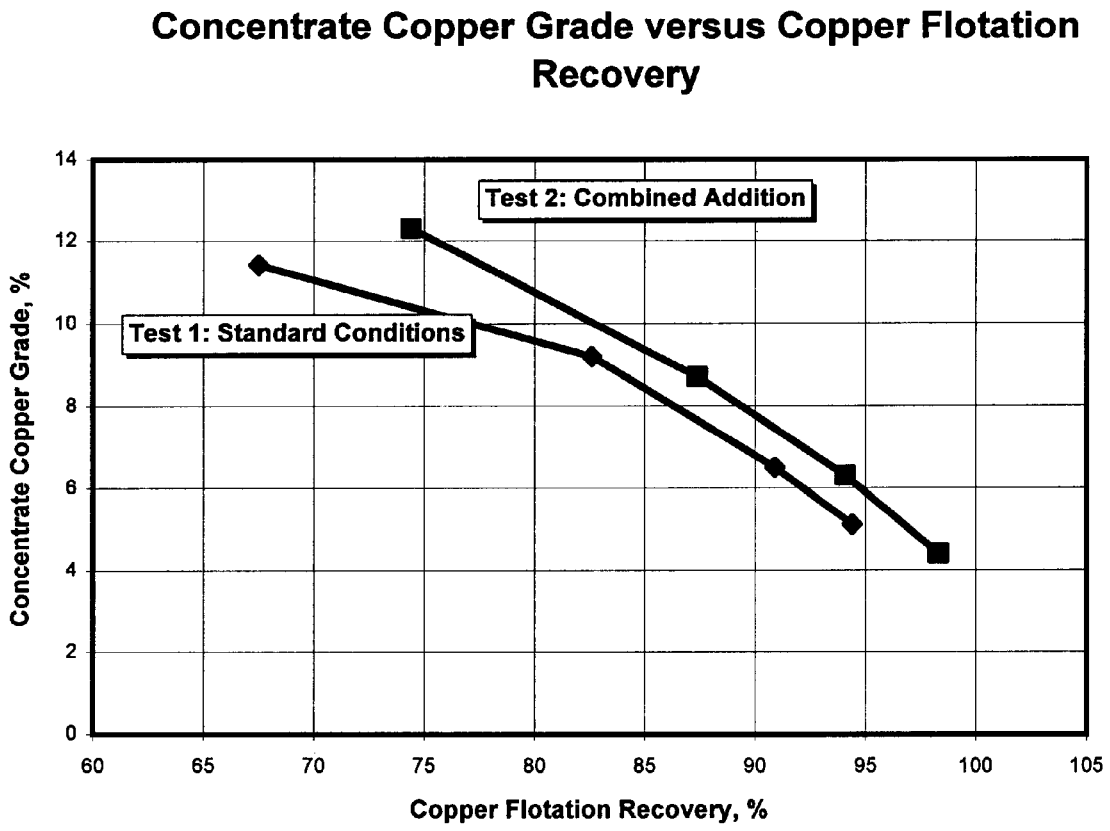
FIG. 1 is a graph of concentrate copper grade versus copper flotation recovery for tests 1 and 2 described below.

The present invention provides a method of increasing both flotation selectivity and effectiveness of a sulfoxy radical containing-reagent added to a mineral separation circuit wherein prior to or simultaneously with the addition of said sulfoxy radical-containing reagent a non-oxidizing gas is added to the mineral separation circuit in a quantity sufficient to achieve a chemical environment conducive to flotation separation of minerals.

The present applicants have found that conditioning a slurry or flotation concentrate having a mixture of valuable materials with a non-oxidizing gas and a sulfoxy radical-containing reagent not only increases the recovery of the valuable minerals but also improves the flotation selectivity of those minerals.

Not wishing to be bound by any particular theory, it is believed the addition of non-oxidizing gas either prior to or simultaneously with the sulfoxy radical-containing reagent increases the effectiveness of the sulfoxy radical-containing reagent in the slurry. The sulfoxy radical-containing reagent has two primary mechanisms for assisting flotation of valuable sulfide minerals, namely the various chemical reactions with the minerals and the removal of dissolved oxygen from the slurry. Both these mechanisms affect mineral floatability. The applicants believe that the non-oxidizing gas appears to assist either or both of these mechanisms.

The present inventive process is suitable for use with a broad range of slurries and flotation concentrates having a mixture of valuable minerals including sulfidic copper minerals or sulfidic and non-sulfidic copper minerals, valuable lead and/or zinc and/or nickel minerals and non-valuable sulfidic iron minerals (particularly pyrite) and non-sulfidic "gangue" material.

The non-oxidizing gas is conveniently to be selected from the group consisting of inert gases, carbon dioxide, methane, ethane, propane and sulfur dioxide, the latter possessing an additional advantage in that it may itself be utilized as a sulfoxy radical-containing reagent. Of the inert gases, nitrogen is most preferred for cost reasons, but other art-recognized inert gases, such as argon, can be utilized as well.

Similarly, as will be clear to persons skilled in the art, there are a wide variety of suitable sulfoxy radical-containing reagents that can be used in conjunction with the present inventive process. Suitable sulfoxy radical-containing reagents include sulfite and bisulfite compounds, alkali metal, ammonium or alkaline earth metal salts thereof, for example, alkali metal salts containing sulfoxy radicals. Examples of specific reagents include sodium sulfite, sodium hydrogen sulphite, sodium metabisulfite, sodium bisulfite, sulfur dioxide gas or solution and the like.

The duration and intensity of the conditioning step carried out in accordance with the present invention will depend upon a number of factors including the type of ore undergoing flotation, the amount and type of sulfoxy radical-containing reagent added in conjunction with the non-oxidizing gas conditioning and the dissolved oxygen content of the slurry.

It is also possible that prior to addition of the collector and flotation of the slurry, but after the non-oxidizing gas/sulfoxy-radical containing reagent conditioning step, the slurry may require oxidative gas conditioning step to a particular dissolved oxygen concentration, e.g. DO≈2 ppm or electrochemical potential which is suitable for flotation of the particular sulfide mineral. Suitable oxidative gases include, air, oxygen, oxygen-enriched air, and the like.

The present inventive process is suitable for application with a wide variety or ores including but not limited to poly-metallic ores containing economic values of copper and/or lead and/or zinc and/or nickel which is frequently in association with iron sulfide. The present process is particularly suitable for separation of copper minerals from other sulfide minerals in poly-metallic ores. By using the present process, the flotation selectivity of the slurry may be improved thereby increasing the quality and grade of the valuable concentrate resulting from the flotation stage(s). This of course provides corresponding increases in efficiency in the smelting operation.

As an example, a typical process employing the present invention may comprise the following. A milled slurry is conditioned for 1 to 10 minutes, preferably 2 to 5 minutes, with a non-oxidizing gas, such as nitrogen, to substantially remove all dissolved oxygen present. A sulfoxy radical-containing reagent, such as sodium metabisulphite (SMBS), is then added and the conditioning with the non-oxidizing gas continued for a further 1 to 10 minutes, after which the flow thereof is discontinued. Appropriate collectors and frothers for effecting flotation of the slurry may then be added and the slurry is conditioned further for one minute. The conditioned slurry is then floated with air to effect recovery of the valuable minerals from the non-valuable minerals.

The non-oxidizing gas may also be applied to the reagent mixing stage, when the reagent is mixed with water to produce an aqueous fluid of suitable concentration for controlled addition to the flotation process.

The present inventive process is also suitable to a range of reagents in particular but not only oxygen-consuming reagents, such as cyanide, xanthates, sulfides, hydrosulfides and admixtures thereof, including sulfoxy radical-containing reagents.

Lastly, an unexpected benefit of the present inventive process is its ability to increase the safety of the flotation circuit. To explain, many sulfoxy compounds are quite hazardous to human health and can produce noxious fumes. Therefore, and in accordance with a further aspect of the invention, there is provided a method for enhancing the safety of a mineral separation circuit which uses a sulfoxy radical-containing reagent, wherein a non-oxidizing gas is provided under pressure to the mineral separation circuit conditioning with said sulfoxy radical containing reagent thereby creating an over-pressure within the mineral separation circuit to expel at least a portion of any fumes arising from the sulfoxy radical-containing reagent. Preferably, these noxious fumes are ducted to the outside of any buildings housing the mineral separation circuits thereby enhancing safety and improving the working environment around the mineral separation circuits. Clearly, this is a substantial additional benefit associated with the present invention. In fact, in some operations, this additional benefit may be the primary reason for employing the present inventive process.

In order that the nature of the present invention may be more clearly understood, the following examples are provided.

By way of example, two flotation tests were conducted on fresh samples of reagentized flotation slurry from a complex massive sulfide copper/lead/zinc ore assaying 1.5% Copper, 3.3% Lead, and 8.4% Zinc to establish the improvement in sulfoxy radical-containing reagent effectiveness by addition of an inert gas, nitrogen. The valuable minerals present included chalcopyrite (Copper), galena (Lead), and sphalerite (Zinc). The major non-valuable sulfide mineral was pyrite.

In the example given, the role of the sulfoxy radical-containing reagent was to improve the flotation selectivity of the copper minerals from the lead and zinc minerals.

Test 1: Standard Conditions

In a 2.5 liter flotation cell sulfuric acid was added to achieve a pH of 5.9. The appropriate quantity of collector was added and the equivalent of 1000 gpt of new feed of the sulfoxy radical-containing reagent sodium bisulfite (SBS) was added. The slurry was conditioned for 5 minutes. At the completion of conditioning, the appropriate quantity of frother was added and flotation with air commenced. Four concentrates were produced from 1, 2, 4, and 8 minutes, respectively of flotation. The four concentrates and flotation tailings were filtered, dried, weighed, and the copper, lead, and zinc content thereof determined by assay.

Test 2: Addition of Nitrogen

A test was conducted in a similar described for Test 1 with the following exceptions:

1) Prior to adjusting the slurry pH with sulfuric acid, the slurry was conditioned with a nitrogen gas purge for 2 minutes. The dissolved oxygen content of the slurry was measured and found to be negligible (i.e. close to zero); and
2) Nitrogen purge was continued through pH adjustment and SBS and collector conditioning. Nitrogen addition ceased prior to frother addition.

Results

The results of the evaluation are summarized as follows:

Test 1: Standard Conditions

| | Concentrate Copper Grade, % | | | Flotation Recovery, % | | |
|---|---|---|---|---|---|---|
| Product | Cu | Pb | Zn | Cu | Pb | Zn |
| Concentrate 1 | 11.4 | 16.0 | 5.8 | 67.5 | 41.2 | 5.5 |
| Concentrates 1 + 2 | 9.2 | 14.2 | 6.5 | 82.6 | 55.7 | 9.5 |
| Concentrates 1 + 2 + 3 | 6.5 | 11.2 | 7.3 | 90.9 | 68.1 | 16.2 |
| Concentrates 1 + 2 + 3 + 4 | 5.1 | 9.2 | 7.8 | 94.4 | 74.8 | 23.3 |

Test 2: Addition of Nitrogen

| | Concentrate Copper Grade, % | | | Flotation Recovery, % | | |
|---|---|---|---|---|---|---|
| Product | Cu | Pb | Zn | Cu | Pb | Zn |
| Concentrate 1 | 12.3 | 13.6 | 4.9 | 74.4 | 39.2 | 5.8 |
| Concentrates 1 + 2 | 8.7 | 11.7 | 5.1 | 87.4 | 55.7 | 10.0 |
| Concentrates 1 + 2 + 3 | 6.3 | 9.7 | 5.4 | 94.1 | 69.2 | 15.7 |
| Concentrates 1 + 2 + 3 + 4 | 4.4 | 7.7 | 6.3 | 98.3 | 81.7 | 27.5 |

Figure 2:
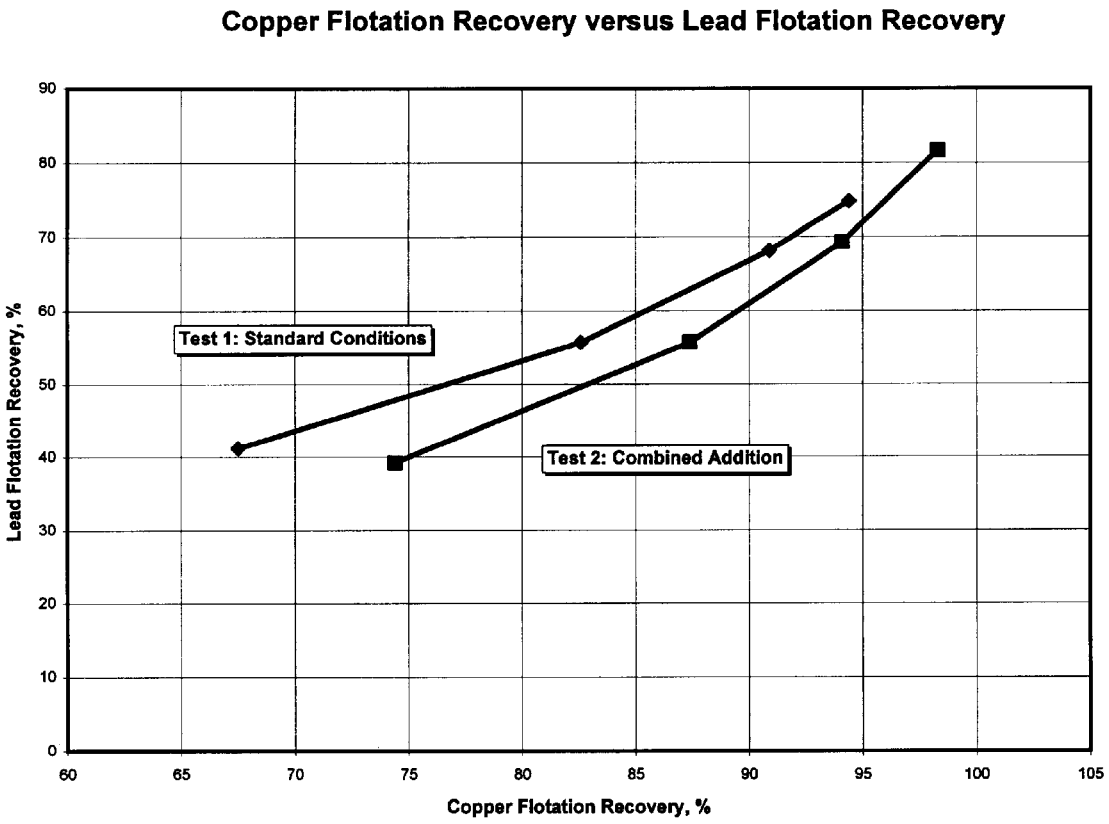
FIG. 2 is a graph of copper flotation recovery versus lead flotation recovery for tests 1 and 2.

The results show that the addition of nitrogen improved the effectiveness of the sulfoxy compound as measured by concentrate copper grade, copper flotation recovery, and flotation selectivity of copper against lead and zinc. These improvements are probably more clearly appreciated on review of the Figures. FIG. 1 clearly shows that the addition of nitrogen increased concentrate copper grade and increased the maximum copper flotation recovery. For this ore, it is also desirable to separate copper from lead, therefore giving the highest copper flotation recovery while maintaining the lowest lead flotation recovery. FIG. 2 figure clearly shows that the addition of nitrogen has improved the flotation selectivity of copper against lead.

Figure 3:
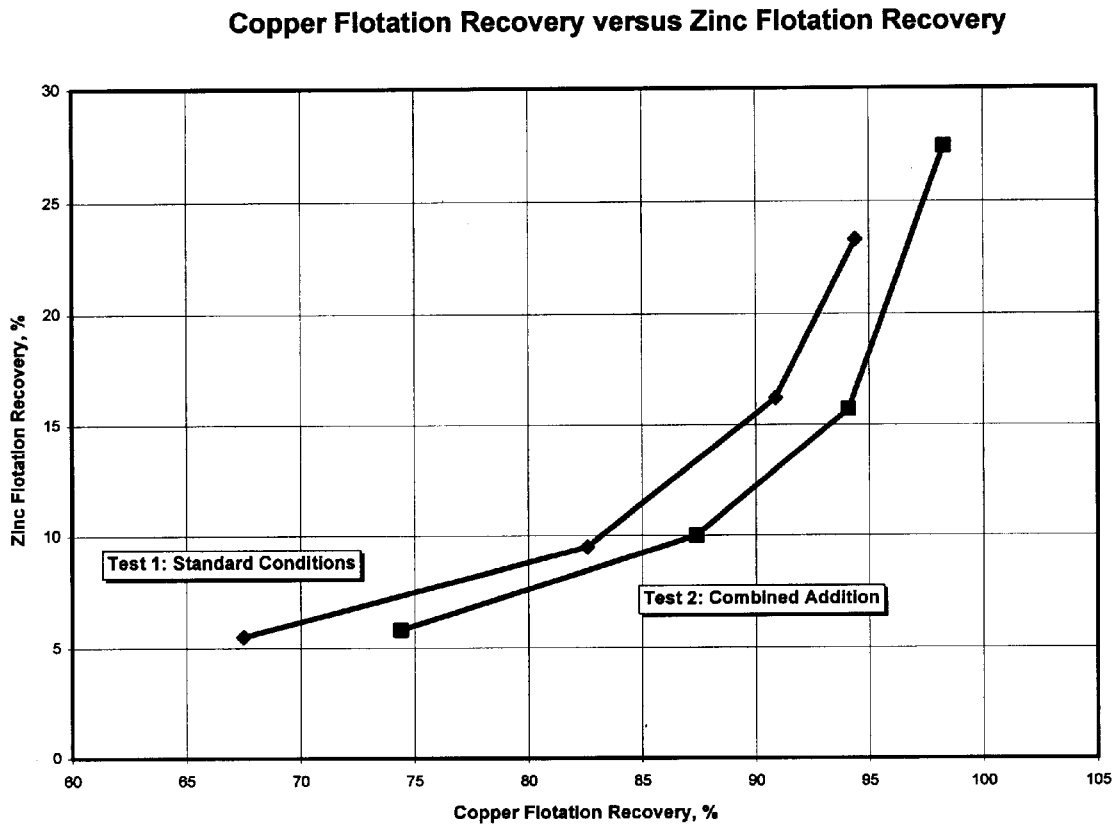
FIG. 3 is a graph of copper flotation recovery versus lead flotation recovery for tests 1 and 2.

Lastly, for the ore tested, it is also desirable to separate copper from zinc, therefore giving the highest copper flotation recovery while maintaining the lowest zinc flotation recovery. FIG. 3 clearly shows that the addition of nitrogen has improved the flotation selectivity of copper against zinc.

The present inventive process may be used with conventional apparatus which will be well-known to persons skilled in the art and it will further be understood that the present invention may be embodied in form other than that described without departing from the spirit or scope of the invention.

We claim:

1. A method of increasing the flotation selectivity and effectiveness of a sulfoxy radical-containing reagent selected from the group consisting of compounds containing metabisulfite, bisulfite and sulfite radicals, alkali metal, alkaline earth metal and ammonium salts of such compounds, and mixtures thereof added to condition a slurry of a mixture of minerals to be separated in a mineral separation circuit while simultaneously enhancing the safety of the circuit comprising conditioning the slurry by introducing, under pressure, prior to, simultaneously with, or both prior to and simultaneously with the introduction of the sulfoxy radical-containing reagent, a quantity of a non-oxidizing gas under pressure comprising one or more inert gases sufficient to achieve a chemical environment in the slurry conductive to the flotation separation of the minerals and create an over-pressure within the circuit to expel at least a portion of any fumes arising from the sulfoxy radical-containing reagent.

2. A method in accordance with claim 1 including the additional step of introducing non-oxidizing gas during a reagent mixing stage in the circuit in which the reagent is mixed with water to produce an aqueous fluid of suitable concentration for controlled addition to the flotation process.

3. A method in accordance with claim 1, wherein the inert gas is nitrogen.

4. A method in accordance with claim 1, wherein said noxious fumes are withdrawn to the outside of any buildings housing the mineral separation circuits thereby enhancing safety and improving the working environment around the mineral separation circuits.

5. A method in accordance with claim 1, wherein the sulfoxy radical-containing reagent is selected from the group consisting of sodium sulfite, sodium metabisulfite, sodium bisulfite and mixtures thereof.

6. A method in accordance with claim 1 additionally including the steps of adding a collector followed by flotation of the slurry, wherein prior to the addition of the collector the slurry undergoes an oxidative gas conditioning step to provide a dissolved oxygen concentration or electrochemical potential which is suitable for flotation of the mineral mixture.

7. A method in accordance with claim 1, wherein the slurry is conditioned with the non-oxidizing gas for between about 1 and 10 minutes.

8. A method in accordance with claim 7, wherein the slurry is conditioned with the non-oxidizing gas for between about 2 and 5 minutes.

* * * * *